US005924480A

United States Patent [19]

Arima et al.

[11] Patent Number: 5,924,480

[45] Date of Patent: Jul. 20, 1999

[54] AIR CONDITIONING SYSTEM

[75] Inventors: Hidetoshi Arima; Nobuhiro Idei; Mamoru Kubo; Masashi Izumi, all of Gunma-ken, Japan

[73] Assignee: Sanyo Electric Co., Ltd., Osaka-fu, Japan

[21] Appl. No.: 09/093,270

[22] Filed: Jun. 8, 1998

[30] Foreign Application Priority Data

Jun. 9, 1997 [JP] Japan ..... 9-151220
Nov. 18, 1997 [JP] Japan ..... 9-316842

[51] Int. Cl.[6] ..... F28D 15/00

[52] U.S. Cl. ..... 165/104.25; 165/104.27; 165/104.32; 165/274; 165/282

[58] Field of Search ..... 165/104.32, 104.27, 165/104.25, 104.26, 274, 282

[56] References Cited

U.S. PATENT DOCUMENTS 1,148,857 8/1915 Reck ..... 165/104.27 X
3,360,035 12/1967 Van Loo et al. ..... 165/104.27
3,411,571 11/1968 Lawrence ..... 165/104.27 X
3,417,815 12/1968 Honert ..... 165/104.27 X
3,561,229 2/1971 Levin ..... 165/104.27 X
5,103,897 4/1992 Cullimore et al. ..... 165/104.26 X
5,535,818 7/1996 Fujisaki et al. ..... 165/104.32 X
5,725,049 3/1998 Swanson et al. ..... 165/104.26

*Primary Examiner*—Christopher Atkinson
*Attorney, Agent, or Firm*—Weingarten, Schurgin, Gagnebin & Hayes LLP

[57] ABSTRACT

An air conditioning system comprises a heat source side machine such as an absorption type refrigerator, a plurality of user side machines more than half of which are disposed below the heat source side machine, and liquid phase and gas phase pipes connecting the heat source side machine with the user side machines to form a closed circuit. A phase-changeable fluid circulates between the heat source side machine and the user side machines by utilizing its own specific gravity difference between the liquid and gas phases and a driving force of an electric pump provided to the liquid phase pipe, so that each of the user side machines can perform cooling operation. A receiver tank is provided to the inlet side of the electric pump, and an upper portion of the receiver tank is connected to the gas phase pipe by a pressure-equalizing pipe so as to improve a start characteristic of the cooling operation. Moreover, the fluid transported from the electric pump is recooled in the heat source side machine so that the fluid heated by the electric pump does not generate bubbles in the liquid phase pipe when being transported to the user side machine that performs cooling operation.

2 Claims, 4 Drawing Sheets

AIR CONDITIONING SYSTEM

BACKGROUND OF THE INVENTION

1. Field of the Invention

The present invention relates to an air conditioning system, and more particularly to a system circulating a phase-changeable fluid between a heat source side machine and a plurality of user side machines all or more than half of which are disposed below the heat source side machine, by utilizing a specific gravity difference between the liquid and the gas phases of the fluid and a driving power of an auxiliary pump for cooling, so that each of the user side machines can perform cooling operation.

2. Background Art

An air conditioning system shown in FIG. 4 is known in the prior art, which utilizes a phase-changeable fluid, i.e., a fluid that can change its phase between the liquid and gas phases by gaining and losing a latent heat, so that a power for transporting the fluid is not required.

In this system, a heat source side machine 1 serving as a condenser is set at a high position of a building, and user side machines 4 are set in rooms to be air-conditioned disposed at lower levels than the heat source side machine 1. The heat source side machine 1 is connected to heat exchangers 5 of the user side machines 4 by a liquid phase pipe 6 and a gas phase pipe 7. This configuration enables the liquid that has been condensed by discharging heat in a heat exchanger 2 of the heat source side machine 1 to flow down to the heat exchanger 5 of the user side machine 4 through the liquid phase pipe 6 by its own gravity, while the gas that has been evaporated by absorbing heat from a warm air in the heat exchanger 5 of the user side machine 4 can flow in the gas phase pipe 7 to reach the heat source side machine 1 that has become in a low pressure after condensing and liquefying of the fluid. Thus, the fluid can circulate between the heat source side machine 1 and the user side machines 4 without any driving power such as an electric pump, thereby a running cost can be saved. In FIG. 4, reference numeral 8 denotes a flow control valve, and reference numeral 9 denotes a blower.

An air conditioning system having a receiver tank 10 and an electric pump 11 connected in series and inserted in the liquid phase pipe 6 as shown with a broken line in FIG. 4 is also known in the art. In such an air conditioning system, the electric pump 11 is controlled in accordance with a liquid level of the phase-changeable fluid in the liquid phase stored in the receiver tank 10, so that the phase-changeable fluid in the liquid phase can be supplied to each of the user side machines sufficiently even if some of the user side machines are set at levels equal to or higher than the level at which the heat source side machine 1 is set.

However, in the above mentioned air conditioning system, a pressure of the fluid at a start time of cooling operation is lowest in the heat source side machine, and the pressure difference between the heat source side machine and the user side machine is large at that time. Accordingly, there was a problem that the fluid was concentrated into the heat source machine and the condensed fluid in the liquid phase could not easily flow out into the liquid phase pipe, resulting in a bad starting characteristics.

In addition, when the phase-changeable fluid is transported to each of the user side machines by a pressure generated by the electric pump, the fluid that has been supercooled in the heat source machine may be heated by a driving mechanism or a transporting mechanism of the electric pump and may become a non-supercooled state. Accordingly, there was a problem that if the fluid was further heated by an outside air via the liquid phase pipe wall before reaching each of the user side machines, the fluid in the liquid phase might boil and generates bubbles disturbing the circulation of the fluid.

Especially, when using a self-cooling type pump that is inexpensive and easy to be maintained since it utilizes a liquid transported by the pump for cooling the pump without using any cooling fan, the temperature rise of the fluid becomes large.

SUMMARY OF THE INVENTION

To solve the above mentioned problem, the present invention provides an air conditioning system, which comprises a heat source side machine, a plurality of user side machines more than half of which are disposed below the heat source side machine, pipes for connecting the heat source side machine to the user side machines, the pipes including a liquid phase pipe and a gas phase pipe constituting a closed circuit, and an auxiliary pump provided to the liquid phase pipe for transporting a fluid. The system circulates a phase-changeable fluid in the closed circuit between the heat source side machine and the user side machines utilizing a difference of a specific gravity between the liquid and gas phases of the fluid, and driving force of the auxiliary pump, so that each of the user side machines can perform at least cooling operation. The system further comprises a receiver tank disposed at the inlet side of the auxiliary pump and a pressure-equalizing pipe that connects an upper portion of the receiver tank to the gas phase pipe.

Preferably, the air conditioning system having the above mentioned structure according to the present invention further comprises a first cooling/heating switching valve, a second receiver tank arranged in parallel with the first cooling/heating switching valve for storing the fluid in the liquid phase condensed by discharging heat in the user side machine, a second pump connected in series with the second receiver tank for supplying the liquefied fluid from the second receiver tank to the heat source side machine, and a bypass having a second cooling/heating switching valve arranged in parallel with a flow path including the receiver tank and the auxiliary pump.

It is preferable that the liquid phase pipe in the upper side of the receiver tank is provided with a check valve that permits the fluid to pass only in the direction to the receiver tank.

Furthermore, the present invention provides an air conditioning system, which comprises a heat source side machine, a plurality of user side machines more than half of which are disposed below the heat source side machine, pipes for connecting the heat source side machine and the user side machine, the pipes including a liquid phase pipe and a gas phase pipe constituting a closed circuit, and an auxiliary pump for cooling provided to the liquid phase pipe for transporting a liquid. The system circulates a phase-changeable fluid in the closed circuit between the heat source side machine and the user side machines utilizing a difference of a specific gravity between the liquid and gas phases of the fluid, and driving force of the auxiliary pump for cooling, so that each of the user side machines can perform cooling operation. The pipes are arranged in such a way that the auxiliary pump for cooling transports the fluid condensed by discharging heat in the heat source side machine, and the fluid reaches the user side machines after being recooled in the heat source side machine.

BRIEF DESCRIPTION OF THE DRAWINGS

These and other objects and advantages of the present invention will become clear from the description with reference to the accompanying drawings, wherein.

DETAILED DESCRIPTION OF THE PREFERRED EMBODIMENTS

Figure 3:
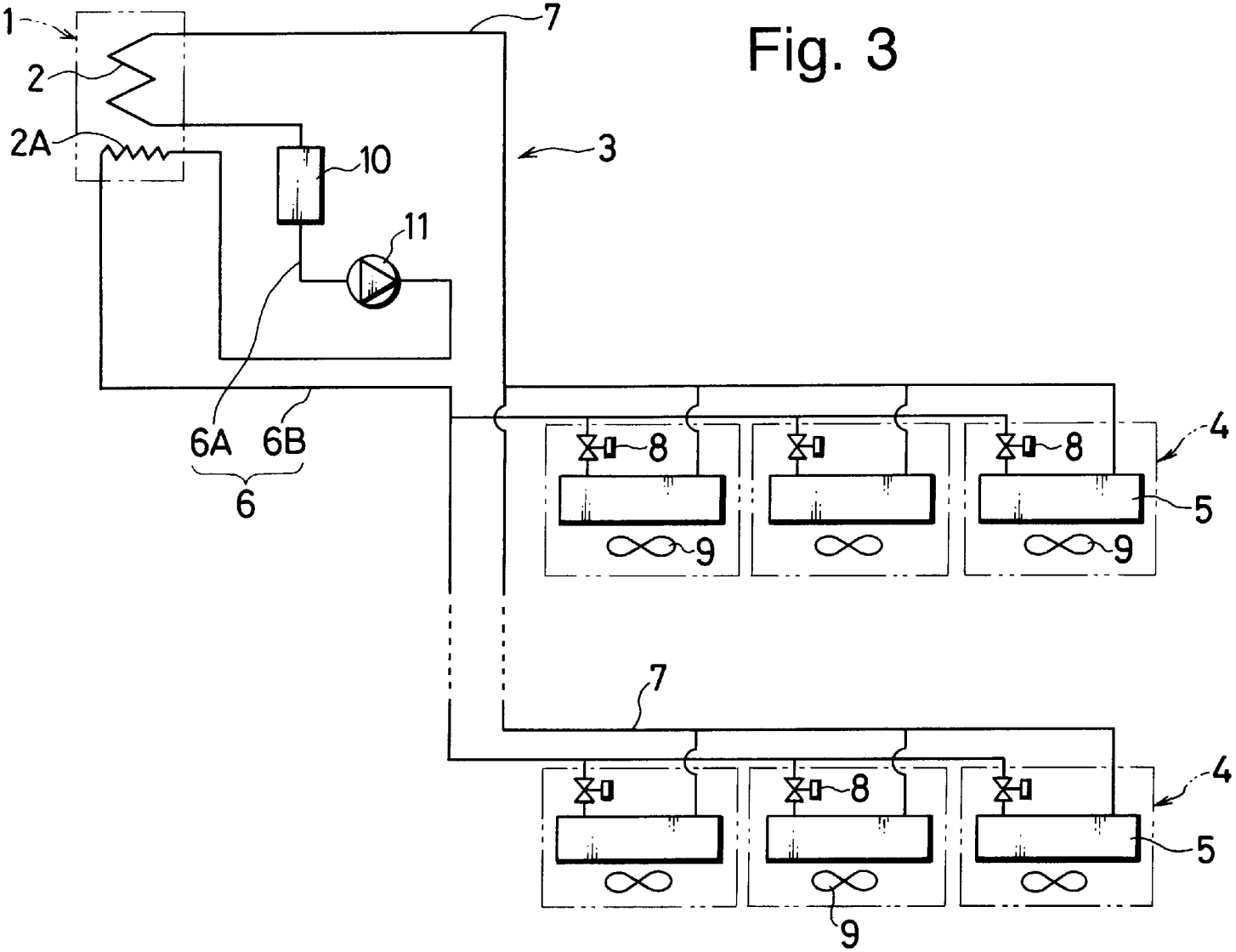
FIG. 3 illustrates still another embodiment of an air conditioning system according to the present invention.
Figure 4:
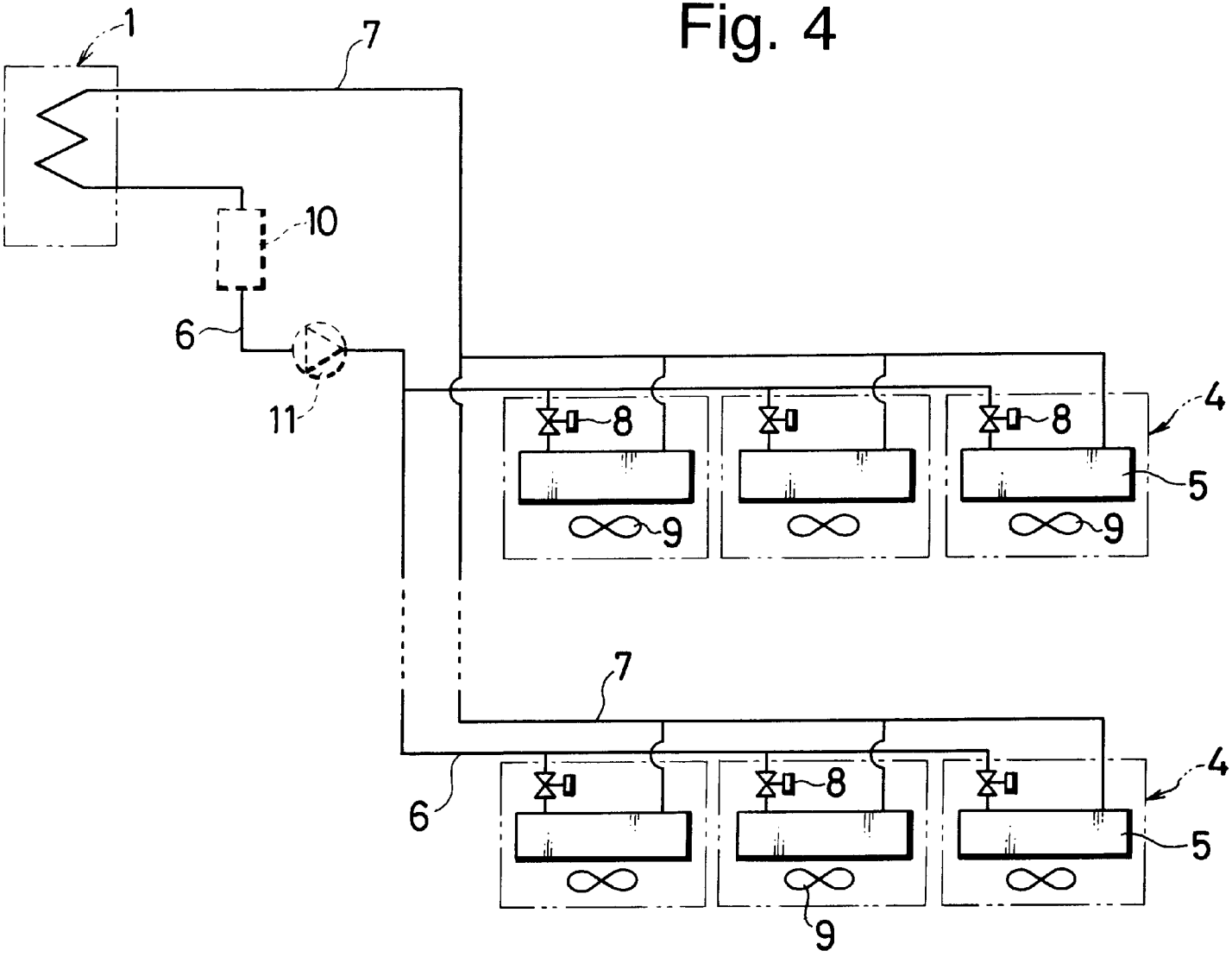
FIG. 4 illustrates an air conditioning system in the prior art.

The present invention will be described in detail hereinafter with reference to an embodiment shown in FIGS. 1–3. For easy understanding, the same reference numerals are used in these figures as in FIG. 4 for the elements having the same functions explained in FIG. 4.

First Embodiment

Figure 1:
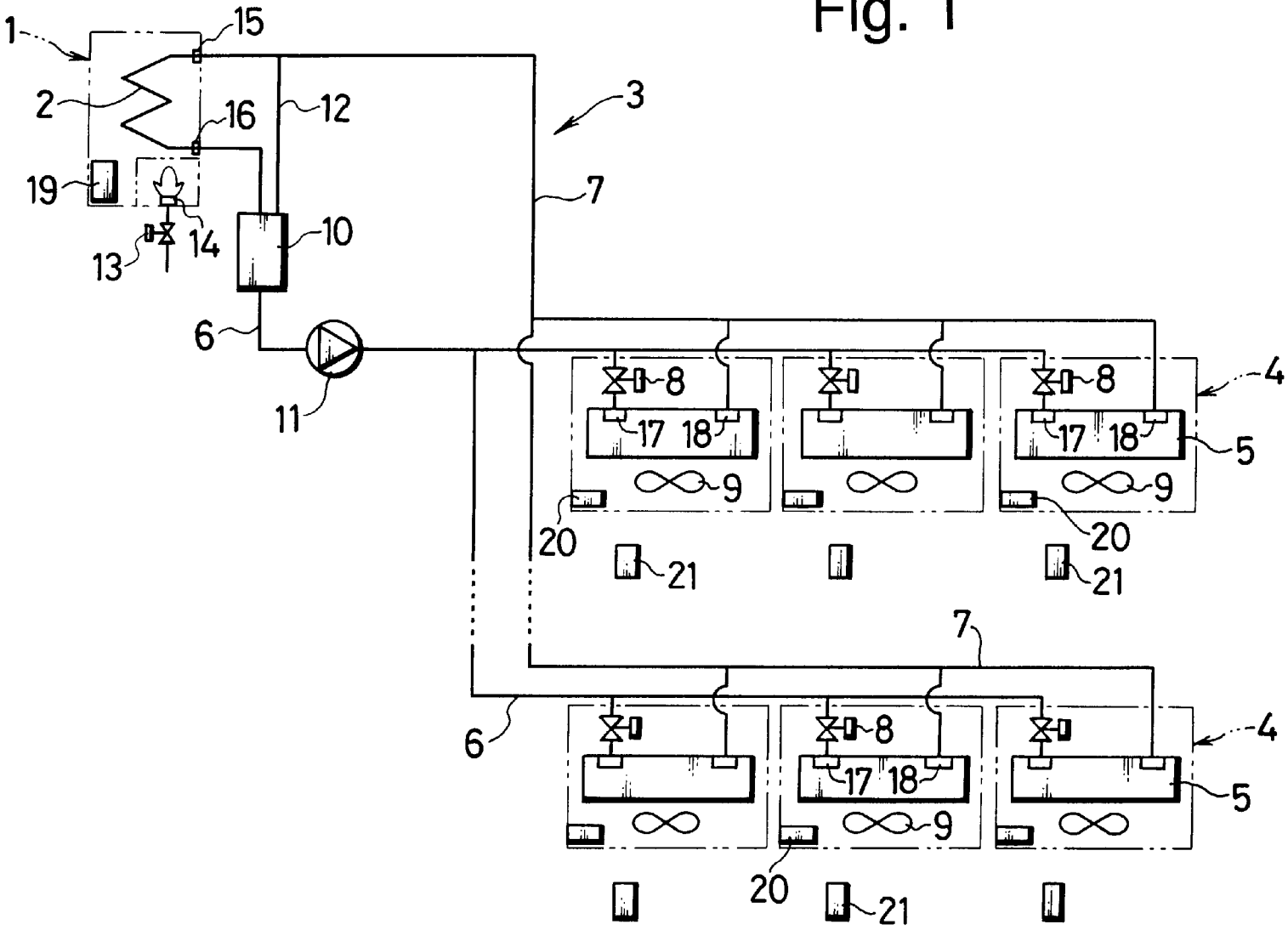
FIG. 1 illustrates an embodiment of an air conditioning system according to the present invention.

FIG. 1 shows an embodiment of the air conditioning system that can perform only cooling operation. Reference numeral 1 denotes a heat source side machine comprising, for example, an absorption type refrigerator that can cool a phase-changeable fluid. The heat source side machine 1 is mounted in a machine room disposed on, for example, a rooftop of a building. The heat source side machine 1 exchanges heat with the phase-changeable fluid in a closed circuit 3 via a heat exchanger 2 disposed within an evaporator of the heat source side machine 1. The phase-changeable fluid is, for example, a refrigerant R-134*a* that can easily evaporate even at a low temperature when the pressure is lowered.

Reference numeral 5 denotes a heat exchanger of a user side machine 4 disposed in each room of the building. The heat exchangers 5 are connected to the heat exchanger 2 of the heat source side machine 1 via a liquid phase pipe 6, a gas phase pipe 7 and a flow control valve 8, thereby forming the closed circuit 3.

The liquid phase pipe 6 is provided with a receiver tank 10 and an electric pump 11 connected in series. The receiver tank stores the liquid refrigerant R-134*a* that has been condensed by discharging heat in the heat exchanger 2 of the heat source side machine 1 and has flowed out. The electric pump 11 transports the refrigerant R-134*a* stored in the receiver tank 10 to the user side machine 4. In addition, according to the present invention an upper portion of the receiver tank 10 and the gas phase pipe 7 are connected with each other by a pressure-equalizing pipe 12.

Reference numeral 13 denotes a fuel adjustment valve provided to a fuel pipe connected to a burner 14 for separating vapor of refrigerant by heating an absorption liquid (not shown) in the absorption type refrigerator. Reference numeral 15–18 denote temperature sensors for detecting temperatures of the refrigerant R-134*a* circulating in the closed circuit 3. The temperature sensor 15 is disposed at an inlet portion of the heat exchanger 2, the sensor 16 at an outlet portion of the heat exchanger 2, the sensor 17 at an inlet portion of the heat exchanger 5, and the sensor 18 at an outlet portion of the heat exchanger 5.

The heat source side machine 1 is provided with a heat source side controller 19, and the user side machine 4 is provided with a user side controller 20. The heat source side controller 19 has a function for controlling opening ratio of the fuel adjustment valve 13 so that a temperature of the refrigerant R-134*a* detected by the temperature sensor 16, which is a temperature of the refrigerant R-134*a* cooled by the heat exchanger 2 to be condensed and transported into the liquid phase pipe 6, becomes a predetermined temperature, e.g., 7 degrees Celsius. The user side controller 20 has a function for controlling the opening ratio of the flow control valve 8 so that a temperature of the refrigerant R-134*a* detected by the temperature sensor 18, which is a temperature of the refrigerant R-134*a* that has performed cooling in the heat exchanger 5, gained heat, and flowed into the gas phase pipe 7, becomes a predetermined temperature, e.g., 12 degrees Celsius.

In addition, each of the user side machines 4 is provided with a remote controller 21 that can communicate with the user side controller 20, and is used for selecting start/stop of cooling, selecting a power of a blower, or setting a temperature.

In the heat source side machine 1, when the opening ratio of the fuel adjustment valve 13 is increased for increasing fuel supply to the burner 14 to raise caloric power, an amount of the refrigerant evaporated and separated from the absorption liquid that is not shown increases. This increased refrigerant vapor discharges heat in a condenser that is not shown to be condensed and supplied to the periphery of the heat exchanger 2 so as to gain heat from the refrigerant R-134*a* flowing in the heat exchanger 2 and to evaporate. Thus, a capacity for cooling the refrigerant R-134*a* flowing in the heat exchanger 2 increases, and a temperature drop increases for the same flow rate. On the contrary, when the opening ratio of the fuel adjustment valve 13 is decreased for reducing caloric power of the burner 14, the capacity for cooling the refrigerant R-134*a* flowing in the heat exchanger 2 decreases and a temperature drop decreases.

On the other hand, in the user side machine 4, the difference between the temperatures detected by the temperature sensors 17 and 18 increases as an air conditioning load is large, while it decreases as the load is small under the condition of the same opening ratio of the flow control valve 8.

A circulation cycle of the refrigerant R-134*a* in the closed circuit 3 is explained as follows. Since the refrigerant R-134*a* is cooled in the heat exchanger 2 of the heat source side machine 1, the refrigerant R-134*a* is condensed and liquefied, flow into the liquid phase pipe 6, is stored in the receiver tank 10, and is transported by the electric pump 11 to be supplied to the heat exchanger 5 of each of the user side machines 4 at a predetermined temperature, e.g., 7 degrees Celsius.

In each of the user side machines 4, since a room air with high temperature is supplied forcibly to the heat exchanger 5 by the blower 9, the liquid refrigerant R-134*a* that has been supplied at the temperature of 7 degrees Celsius from the heat source side machine 1 gains heat from the room air to evaporate for performing cooling operation. The evaporated refrigerant R-134*a* flows in the gas phase pipe 7 and reaches the heat exchanger 2 of the heat source side machine 1 that is in a low pressure due to the condensation of the fluid therewithin, thereby performing circulation.

In this circulation of the refrigerant R-134*a*, if a cooling load of a certain user side machine 4 increases (or decreases) and the temperature of the refrigerant R-134*a* detected by the temperature sensor 18 of the user side machine 4 rises (or drops), the user side controller 20 of the user side machine 4 gives a control signal to the corresponding flow control valve 8 to increase (or decrease) the opening ratio of the valve 8 so that the temperature rise (or drop) can be compensated. Thus, the amount of the refrigerant R-134*a* flowing into the heat exchanger 5 of the user side machine 4 increases (or decreases), thereby the temperature rise (or drop) of the refrigerant R-134*a* is canceled.

If the temperature of the refrigerant R-134*a* detected by the temperature sensor 16 changes when the refrigerant R-134*a* with a different temperature flows into the heat source side machine 1 or a flow rate of the refrigerant R-134*a* flowing into the heat source side machine 1 changes due to a variation of the cooling load, the heat source side controller 19 controls the opening ratio of the fuel adjustment valve 13 so as to compensate the temperature change.

When the cooling operation starts, the refrigerant R-134*a* in the closed circuit 3 discharges heat in the heat exchanger 2 of the heat source side machine 1 to be condensed, so that the pressure at the portion decreases and a pressure difference between the portion and the user side machine 4 increases. However, since the upper portion of the receiver tank 10 is connected to the gas phase pipe 7 via the pressure-equalizing pipe 12 for equalizing pressures at both sides of the heat exchanger 2, the liquid refrigerant R-134*a* condensed in the heat exchanger 2 can easily flow down to the liquid phase pipe 6 by its own gravity. Thus, a start characteristic of cooling operation can be improved.

Second Embodiment

Figure 2:
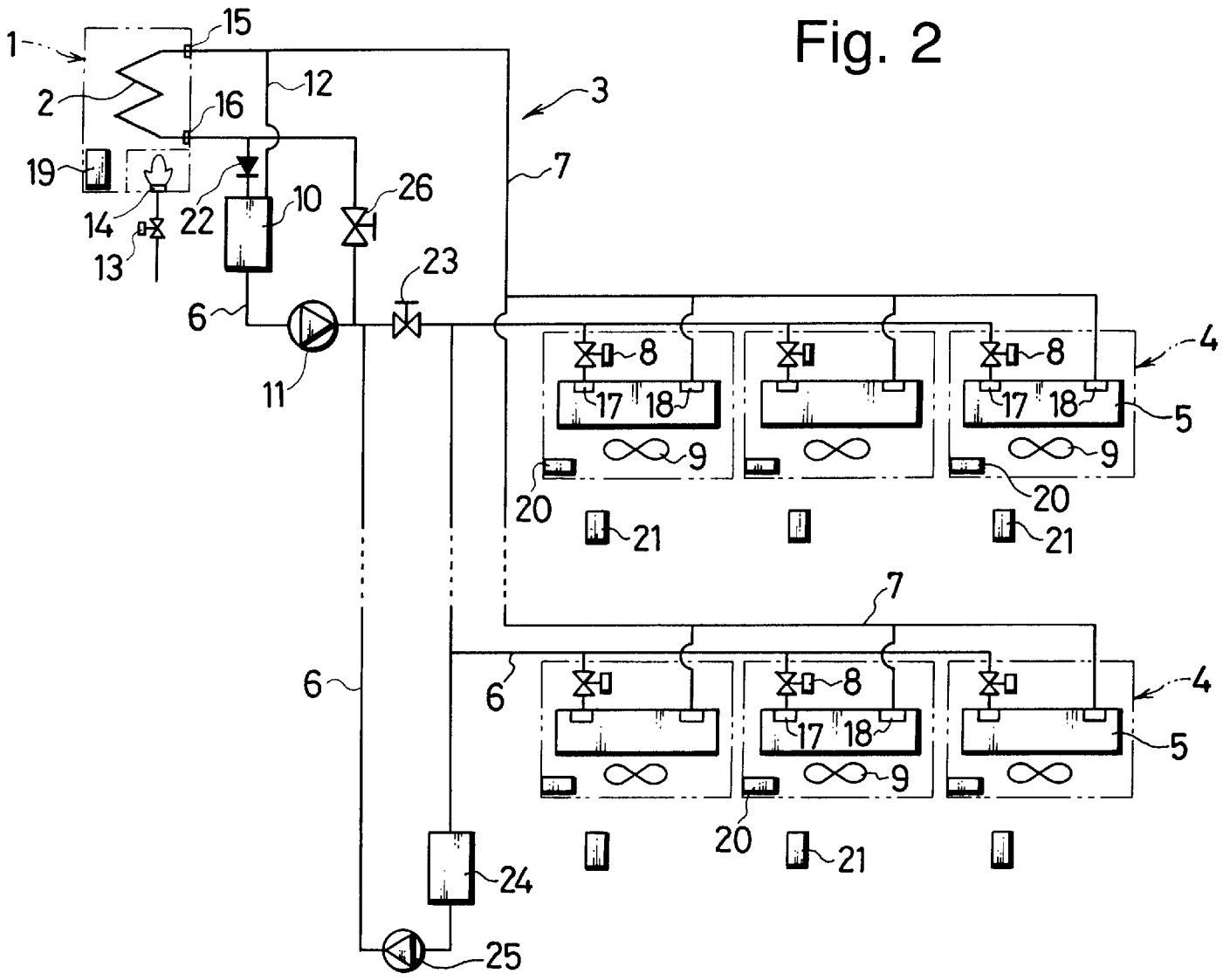
FIG. 2 illustrates another embodiment of an air conditioning system according to the present invention.

FIG. 2 illustrates a second embodiment of the present invention. This embodiment comprises a check valve 22 disposed at the upper side of the receiver tank 10, through which the fluid can pass only in the direction to the receiver tank 10, and a cooling/heating switching valve (opening and closing valve) 23 disposed at the lower side of the electric pump 10.

Furthermore, a receiver tank 24 for storing the liquid refrigerant R-134*a* condensed by discharging heat in the heat exchanger 5 of the user side machine 4, an electric pump 25 for transporting the refrigerant R-134*a* from the tank 24 to the heat source side machine 1, and a cooling/heating switching valve (opening and closing valve) 26 are connected in series.

In this structure, if the operation of the electric pump 25 is stopped, the opening and closing valve 26 is closed and the opening and closing valve 23 is opened, the same structure as the first embodiment is formed. Thus, the good start characteristic for cooling operation can be obtained as mentioned above when the heat source side machine 1 performs cooling operation.

On the other hand, if the opening and closing valve 23 is closed, the opening and closing valve 26 is opened, the operation of the electric pump 11 is stopped, and the electric pump 25 is operated for heating operation in the heat source side machine 1, the refrigerant R-134*a* in the closed circuit 3 is heated by the heat exchanger 2 of the heat source side machine 1 to be evaporated. Then, the refrigerant R-134*a* is supplied to the heat exchanger 5 of each of the user side machines 4 via the gas phase pipe 7 at a predetermined temperature, e.g., 55 degrees Celsius. In each of the heat exchangers 5, since a room air with a low temperature is supplied forcibly by the blower 9, the refrigerant R-134*a* discharges heat to be condensed for performing heating operation. In addition, the condensed refrigerant R-134*a* passes through the flow control valve 8 and is stored in the receiver tank 24, and the refrigerant R-134*a* flows back to the heat exchanger 2 of the heat source side machine 1 via the opening and closing valve 26 by the driving force of the electric pump 25, thereby the circulation of the refrigerant R-134*a* can be performed. Thus, this embodiment can perform cooling or heating operation selectively.

In this air conditioning system, since the check valve 22 is disposed at the upper side of the receiver tank 24, a back-flow of the refrigerant R-134*a* from the liquid phase pipe 6 disposed at the upper side of the receiver tank 24 to the user side machine 4 is prevented even if the refrigerant R-134*a* is condensed to generate a negative pressure in the heat exchanger 2 of the heat source side machine 1 at the start time of cooling operation.

The absorption type refrigerator that can perform cooling and heating function in the heat exchanger 2 disposed in the evaporator of the heat source side machine 1 is disclosed in Japanese Patent Unexamined Publication Hei 7-318189, for example.

The control process for heating operation is explained below. For example, if a heating load of a certain user side machine 4 increases (or decreases) and the temperature of the refrigerant R-134*a* detected by the temperature sensor 17 of the user side machine 4 drops (or rises), the user side controller 20 gives a control signal to the corresponding flow control valve 8 to increase (or decrease) the opening ratio of the valve 8 so that the temperature drop (or rise) can be compensated. Thus, the amount of the refrigerant R-134*a* flowing into the heat exchanger 5 of the user side machine 4 increases (or decreases), thereby the temperature drop (or rise) of the refrigerant R-134*a* detected by the temperature sensor 18 is canceled.

If the temperature of the refrigerant R-134*a* detected by the temperature sensor 15 changes when the refrigerant R-134*a* with a different temperature flows into the heat source side machine 1 or a flow rate of the refrigerant R-134*a* flowing into the heat source side machine 1 changes due to a variation of the cooling load, the heat source side controller 19 controls the opening ratio of the fuel adjustment valve 13 so as to compensate the temperature change.

The present invention is not limited to the above explained embodiments, but can be embodied in different other variations not departing from the concept of the present invention.

For example, the portion connecting the electric pump 11 and the opening and closing valve 23 in the liquid phase pipe 6, and the portion connecting the electric pump 25 and the opening and closing valve 26 can be arranged not to communicate with each other.

In the system structure shown in FIG. 2, the opening and closing valve 26 can be eliminated if the check valve 22 is eliminated.

The temperature sensors 17 and 18 can be arranged to detect a temperature change of the room air blowing to the heat exchanger 5. Alternatively, the temperature sensors 17 and 18 can be replaced with pressure sensors for detecting the pressure difference of the refrigerant R-134*a* between the inlet and outlet portions of the heat exchanger 5, and outputting the detected signal to the user side controller 20 as the load of the air conditioning.

The phase-changeable fluid sealed in the closed circuit 3 is not limited to R-134*a*, but can be R-407c, R-404A, R-410c or other refrigerants that can change its phase easily by a temperature and pressure control.

As explained above, according to the air conditioning system of the present invention, a start characteristic of the cooling operation is improved so that a quick cooling can be performed.

Third Embodiment

A third embodiment of the present invention will be explained below with reference to FIG. 3. In this embodiment, the liquid phase pipe 6 includes a suction side liquid phase pipe 6A connecting the inlet of the electric pump 11 to the outlet of the receiver tank 10, and an outlet side liquid phase pipe 6B connecting the outlet of the electric pump 11 to each of the user side machine 4 via a second heat exchanger 2A of the heat source side machine 1 that is disposed in the same way as the heat exchanger 2.

The electric pump 11 transports the liquid refrigerant R-134*a* condensed by discharging heat in the heat source side machine 1 via the heat exchanger 2A into the user side machines 4 more than half of which are disposed below the heat source side machine 1. Therefore, a compact type pump can be used as the electric pump 11.

The heat source side machine 1 has a function of controlling the temperature of the refrigerant R-134*a* cooled and condensed in the heat exchanger 2A to flow in the liquid phase pipe 6 at a predetermined temperature, e.g., 7 degrees Celsius. The user side machine 4 has a function of controlling the opening ratio of the flow control valve 8 so that the temperature of the refrigerant R-134*a* evaporated after cooling in the heat exchanger 5 and gaining heat to flow in the gas phase pipe 7 becomes a predetermined temperature, e.g., 12 degrees Celsius.

A circulation cycle of the refrigerant R-134*a* in the closed circuit 3 during the cooling operation is explained as follows. The refrigerant R-134*a* is cooled and condensed in the heat exchanger 2 of the heat source side machine 1, flows in the suction side liquid phase pipe 6A, and is stored in the receiver tank 10. This refrigerant R-134*a* is transported by the electric pump 11 to be supplied to the heat exchanger 5 of each of the user side machines 4 at a predetermined temperature, e.g., 7 degrees Celsius after recooled in the heat exchanger 2A of the heat source side machine 1.

In each of the user side machines 4, a room air with high temperature is supplied forcibly to the heat exchanger 5 by the blower 9, and the refrigerant R-134*a* gains heat from the room air via a pipe wall of the heat exchanger 5 to perform cooling operation. The gas refrigerant R-134*a* after gaining heat and evaporated flow in the gas phase pipe 7 and reaches the heat exchanger 2 of the heat source side machine 1 in which the refrigerant R-134*a* has been condensed and a pressure has been lowered. The gas refrigerant R-134*a* that has reached the heat exchanger 2 of the heat source side machine 1 discharges heat again and condensed there. Thus, the circulation of the refrigerant R-134*a* is performed.

In this way, the electric pump 11 can be constituted, for example, with an inexpensive and easy to maintain, self-cooling type canned motor, whose generating heat in an electric motor portion can be discharged to the refrigerant R-134*a* transported by the electric pump 11. On the other hand, even if the temperature of the refrigerant R-134*a* rises when being transported with a pressure, the refrigerant R-134*a* will be in the supercooled state when being supplied finally from the heat source side machine 1. Therefore, even if the refrigerant R-134*a* is heated a little by the outside air via the pipe wall of the liquid phase pipe 6, it does not generate bubbles before reaching each of the user side machines, and does not cause any obstacle to the circulation of the refrigerant R-134*a*. Thus, the heat exchanger 5 of each of the user side machines can always perform cooling operation in the normal state.

The heat exchanger 2A that cools the refrigerant R-134*a* flowing inside it can be disposed at a gas phase portion of the evaporator in the absorption type refrigerator that is used as the heat source side machine, in the same way as the heat exchanger 2, or can be disposed at a liquid phase portion (a reservoir of the refrigerant) of the evaporator.

While the presently preferred embodiment of the present invention has been shown and described, it will be understood that the present invention is not limited thereto, and that various changes and modifications may be made by those skilled in the art without departing from the scope of the invention as set forth in the appended claims.

What is claimed is:

1. An air conditioning system, comprising:

a heat source side machine;

a plurality of user side machines more than half of which are disposed below the heat source side machine;

pipes for connecting the heat source side machine with the user side machines, the pipes including a liquid phase pipe and a gas phase pipe so as to form a closed circuit;

an auxiliary pump provided to the liquid phase pipe;

a first cooling/heating switching valve provided to the liquid phase pipe at the lower side of the auxiliary pump;

a phase-changeable fluid sealed in the closed circuit to circulate between the heat source side machine and the user side machines by its own specific gravity difference between the liquid and gas phases and a driving force of the auxiliary pump, so that each of the user side machines can perform cooling operation;

a first receiver tank disposed at the inlet side of the auxiliary pump;

a pressure-equalizing pipe connecting an upper portion of the first receiver tank with the gas phase pipe;

a second receiver tank arranged in parallel with the first cooling/heating switching valve, for storing the fluid condensed by discharging heat in the user side machines;

a second pump connected in series with the second receiver tank, for supplying the fluid from the second receiver tank to the heat source side machine; and a bypass having a second cooling/heating switching valve arranged in parallel with a flow path including the first receiver tank and the auxiliary pump.

2. The air conditioning system according to claim 1, further comprising a check valve provided to the liquid phase pipe at the upper side of the first receiver tank, the check valve permitting the fluid to pass only in the direction to the first receiver tank.

* * * * *